US012072157B2

(12) United States Patent
Elftmann, Jr.

(10) Patent No.: US 12,072,157 B2
(45) Date of Patent: Aug. 27, 2024

(54) QUICK-RELEASE TAKE-DOWN SYSTEMS AND METHODS

(71) Applicant: Arthur Joseph Elftmann, Jr., Glendale, AZ (US)

(72) Inventor: Arthur Joseph Elftmann, Jr., Glendale, AZ (US)

( * ) Notice: Subject to any disclaimer, the term of this patent is extended or adjusted under 35 U.S.C. 154(b) by 0 days.

(21) Appl. No.: 18/201,573

(22) Filed: May 24, 2023

(65) Prior Publication Data

US 2023/0400272 A1 Dec. 14, 2023

Related U.S. Application Data

(60) Provisional application No. 63/350,389, filed on Jun. 8, 2022.

(51) Int. Cl.
*F41A 11/00* (2006.01)
*F41A 3/66* (2006.01)

(52) U.S. Cl.
CPC ..... *F41A 11/00* (2013.01); *F41A 3/66* (2013.01)

(58) Field of Classification Search
CPC ..... F41A 11/00; F41A 3/66
See application file for complete search history.

(56) References Cited

U.S. PATENT DOCUMENTS 9,791,229 B1 * 10/2017 Cross ..... F41A 11/00
11,536,525 B2 * 12/2022 Kusnierz ..... F41A 9/82

* cited by examiner

*Primary Examiner* — Reginald S Tillman, Jr.
(74) *Attorney, Agent, or Firm* — The Law Offices of Lisa & Lesko, LLC; Justin J. Lesko, Esq.

(57) ABSTRACT

A quick-release take-down assembly for a weapon, including a quick-release, spring-loaded cam lever or handle, or a set of clips, that enables a handler to quickly and efficiently release the upper assembly from the lower assembly to access the bolt, carrier, and other components of the weapon for cleaning and other purposes. The quick-release system eliminates the need for standard, sliding take-down pins that can become stuck, require detent pins/springs in order to stay in place, require tools, and/or become misaligned.

20 Claims, 16 Drawing Sheets

QUICK-RELEASE TAKE-DOWN SYSTEMS AND METHODS

CROSS REFERENCE TO RELATED APPLICATIONS

This application claims the benefit of Provisional Application No. 63/350,389 filed on Jun. 8, 2022 which is hereby incorporated by reference in its entirety

BACKGROUND OF THE INVENTION

Field of the Invention

Described herein is a quick-release take-down assembly for a weapon, such as an AR-15. The take-down system includes a quick-release, spring-loaded cam lever or handle that enables a handler to quickly and efficiently release the upper assembly from the lower assembly to access the bolt, carrier, and other components of the weapon for cleaning and other purposes. The upper and lower assembly are modified from standard AR-15 components to make them compatible with the quick-release system. The quick-release system eliminates the need for standard, sliding take-down pins that can become stuck, require detent pins/springs in order to stay in place, require tools, and/or become misaligned.

Description of Known Art

An exemplary, standard take-down of an AR-15 weapon (including removing the upper assembly from the lower assembly) video can be found at the following link: https://youtu.be/SCYneYcoXDc.

SUMMARY OF THE INVENTION

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. The full scope of the invention is not limited to the examples that are described below.

The examples shown in FIGS. 1-14 comprise (inter alfa) the following elements: (1) an upper assembly 10, (2) a lower assembly 12, (3) a wedge 18 that locks the upper assembly 10 into place by force of a spring 26 located within bore 24 of the lower assembly 12, and (4) an L-shaped cam arm 14 that rotates on cam pin 16 to lock or unlock the upper assembly 10 (or in the alternative, a T-handle 36 to lock or unlock the upper assembly 10).

In the example shown in FIGS. 1-6, in the "closed" position for the upper assembly 10 (shown in FIGS. 1-4), the cam arm 14 fits into a groove of the lower assembly 12, as shown in the figures. The spring 26 within the bore 24 of the lower assembly 12 presses against the bottom of the wedge 18, which causes the top of the wedge 18 to press against the angled surface 30 of the upper assembly 10 to keep the upper assembly 10 in place. The upper assembly 10 includes hooks that fit around pins 32 and 34. Unlike standard take down pins, the pins 32 and 34 are not required to be mobile or slide-able. For example, pins 32 and 34 can be roll pins or pressed-in precision ground pins that are fixed within the lower assembly 10. They can even be welded to the lower assembly 10, or machined as part of the lower assembly 10, if desired. In short, the pins 32 and 34 provide something for the lower assembly 10 to latch onto, but they are not required to move or adjust as part of the take-down process.

To move the cam arm 14 to the "open" position (shown in FIGS. 5-6), a user grabs the cam arm 14 and rotates it by 90 degrees on cam pin 16 that also extends through shaft 28. As shown in FIG. 4, part of the cam arm protrudes beyond the back of the lower assembly 12 to provide the handler something to grab onto. The rotation process of the cam arm 14 causes shaft 28 to move downward linearly against the spring force of the spring 26, thereby pulling the wedge 18 away from the angled surface 30 of upper assembly 10 and compressing the spring 26 within the bore 24. The radial portion 20 of cam arm 14 slides against the lower assembly 12 during this rotation process until the flat portion 22 locks the cam arm 14 into place by pressing against the surface of the lower assembly 12, as shown in FIGS. 5 and 6. With the cam arm 14 locked in this position, the handler of the gun can remove the upper assembly 10 from the pins 32 and 34 by sliding the upper assembly 10 in the direction shown by the arrow in FIG. 6. The handler can then access the components housed within the lower assembly 12 as necessary. The cam arm 14 can remain locked this open position during cleaning/accessing or be rotated back to the closed position (in either case, the wedge will not be in contact with the upper assembly 10, because the upper assembly 10 has been removed). When the handler is ready to reattach the upper assembly 10 to the lower assembly 12, the handler simply puts the cam arm 14 in the open position shown in FIGS. 5 and 6 (if its not already in the open position), slides the upper assembly back onto the pins 32 and 34, and rotates the cam arm 14 by 90 degrees back to the closed position shown in FIGS. 1-4.

In the example shown in FIGS. 7-14, in the "closed" position for the upper assembly 10 (shown in FIGS. 7-10), the T-handle 36 presses against the lower assembly 12, as shown in the figures. In this example, the T-handle 36 can be machined as part of the shaft 28, welded to the shaft 28, or otherwise attached to shaft 28. In the alternative, the T-handle 36 can be attached to the shaft 28 through a rotatable mechanism such as a bearing or with a washer, so that the T-handle 36 rotates on the shaft 28 without rotating the shaft 28. The spring 26 within the bore 24 of the lower assembly 12 presses against the bottom of the wedge 18, which causes the top of the wedge 18 to press against the angled surface 30 of the upper assembly 10 to keep the upper assembly 10 in place. The upper assembly 10 includes hooks that fit around pins 32 and 34. Unlike standard take down pins, the pins 32 and 34 are not required to be mobile or slide-able. For example, pins 32 and 34 can be roll pins or pressed-in precision ground pins that are fixed within the lower assembly 10. They can even be welded to the lower assembly 10, or machined as part of the lower assembly 10, if desired. In short, the pins 32 and 34 provide something for the upper assembly 10 to latch onto, but they are not required to move or adjust as part of the take-down process.

To move the T-handle 36 to the "open" position (shown in FIGS. 11-14), a handler grabs the T-handle 36 and pulls it downward to pull the shaft 28 downward linearly against the spring force of the spring 26, thereby pulling the wedge 18 away from the angled surface 30 of upper assembly 10 and compressing the spring 26 within the bore 24. The handler pulls the T-handle 36 until part of the shaft 28 extends beyond the bottom of the lower assembly 12, rotates the T-handle 36 by 90 degrees, and then releases the T-handle 36 so that a flat surface of the T-handle (the portion labeled 38) contacts the bottom of the lower assembly 12. The shaft 28 rotates with the T-handle 36 if the T-handle 36 is not attached via a rotatable mechanism such as a bearing or with a washer. In the alternative, if the T-handle 36 is attached via a rotatable mechanism such as a bear or washer, the T-handle 36 rotates on the shaft 28 without rotating the shaft 28. With the T-handle 36 locked in this position, the handler of the gun can remove the upper assembly 10 from the pins 32 and 34 by sliding the upper assembly 10 in the direction shown by the arrow in FIG. 13. The handler can then access the components housed within the lower assembly 12 as necessary. The T-handle 36 can remain locked this open position during cleaning/accessing or be rotated back to the closed position (in either case, the wedge will not be in contact with the upper assembly 10, because the upper assembly 10 has been removed). When the handler is ready to reattach the upper assembly 10 to the lower assembly 12, the handler simply puts the T-handle 36 in the open position shown in FIGS. 11-14 (if it is not already in the open position), slides the upper assembly back onto the pins 32 and 34, and pulls and rotates the T-handle 36 by 90 degrees back to the closed position shown in FIGS. 7-10.

The cam arm 14 T-handle 36 are intended to be exemplary forms of the locking/unlocking mechanism, and other known forms of pulling/locking mechanisms can be used to pull down the shaft 28 to release the wedge 18, such as ball handle, a square handle, etc.

FIGS. 15-17 depict yet another example of the quick-release take down. In the example shown in FIGS. 15-17, in the "closed" position for the upper assembly 10 (shown in FIGS. 15-17), clips 40*a* and 40*b* latch onto plate 42 of lower assembly 12. As shown in FIG. 16, clips 40*a* and 40*b* are configured to rotate on pins 44*a* and 44*b*. Springs 46*a* and 46*b* press against clips 40*a* and 40*b* to keep the upper assembly attached in the "closed position" by preventing rotation.

To "open" the clips 40*a* and 40*b* so that the upper assembly can be removed from the lower assembly, a user squeezes the pressing areas 48*a* and 48*b* of the clips toward the upper assembly 10, which causes the clips 40*a* and 40*b* to rotate on pins 44*a* and 44*b* and unlatch from the plate 42 of the lower assembly 12. In the example shown in the figures, pressing areas 48*a* and 48*b* have knurling, although knurling is not required. With the pressing areas 48*a* and 48*b* squeezed and the clips 40*a* and 40*b* unlatched from the plate 42, a user simply slides the hooks of the upper assembly 10 off of the pins 32 and 34.

In the example shown in FIGS. 15-17, when the upper assembly 10 is removed from the lower assembly 12 for cleaning/accessing the inside of the weapon, as described above, and the user stops squeezing the pressing areas 48*a* and 48*b*, the springs 46*a* and 46*b* cause the clips 40*a* and 40*b* rotate on pins 44*a* and 44*b*. However, protrusions 50*a* and 50*b* are optionally included as part of clips 40*a* and 40*b* to limit this rotation: protrusions 50*a* and 50*b* press against the wall of the upper assembly 10 when the pressing areas 48*a* and 48*b* are released by the user. This keeps the front portions of the clips 40*a* and 40*b* "open" and not pressing against the upper assembly 10. In this way, if a user desires to attach the upper assembly 10 back onto the lower assembly 12, with the clips 40*a* and 40*b* in the "open" position, the user simply slides the upper assembly 10 onto the lower assembly 12 until the hooks latch onto the pins 32 and 34 and the clips 40*a* and 40*b* latch onto plate 42 of lower assembly 12.

The Figures show only certain portions of the weapon that are necessary for illustrating the described system, and the full weapon is not depicted.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112, ¶6. Thus, the use of the words "function," "means" or "step" in the Detailed Description or Description of the Drawings or claims is not intended to somehow indicate a desire to invoke the special provisions of 35 U.S.C. § 112, ¶6, to define the invention. To the contrary, if the provisions of 35 U.S.C. § 112, ¶6 are sought to be invoked to define the inventions, the claims will specifically and expressly state the exact phrases "means for" or "step for and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. § 112, ¶6. Moreover, even if the provisions of 35 U.S.C. § 112, ¶6 are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

BRIEF DESCRIPTION OF THE DRAWINGS

A more complete understanding of the present invention may be derived by referring to the detailed description when considered in connection with the drawing figures wherein.

Figure 1:
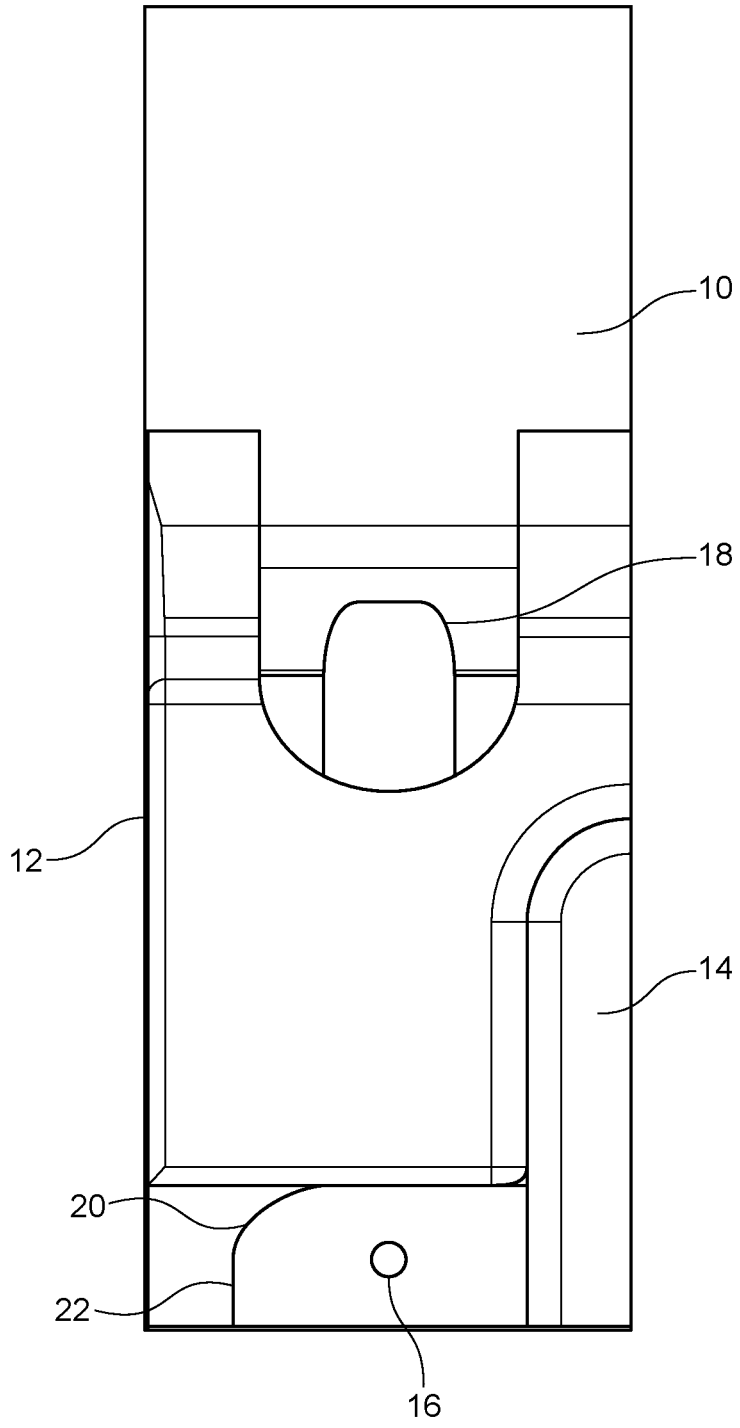
FIG. 1 is a back view of the first example, with the cam arm 14 in the "closed" position.
Figure 2:
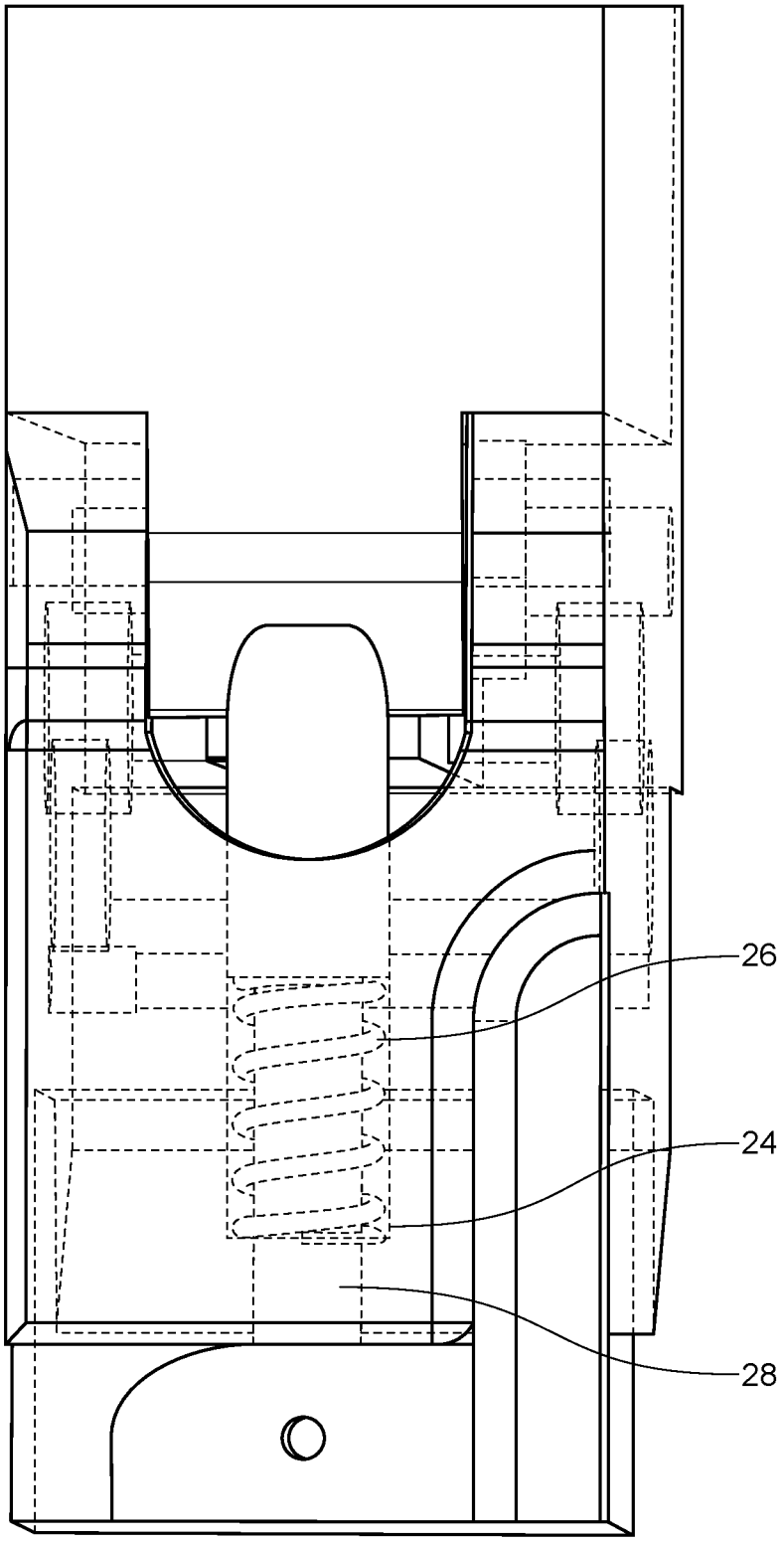
FIG. 2 is a back view of the first example, with the cam arm 14 in the "closed" position, and with the lower assembly 12 shown with invisible walls to reveal certain inner components of the lower assembly 12.
Figure 3:
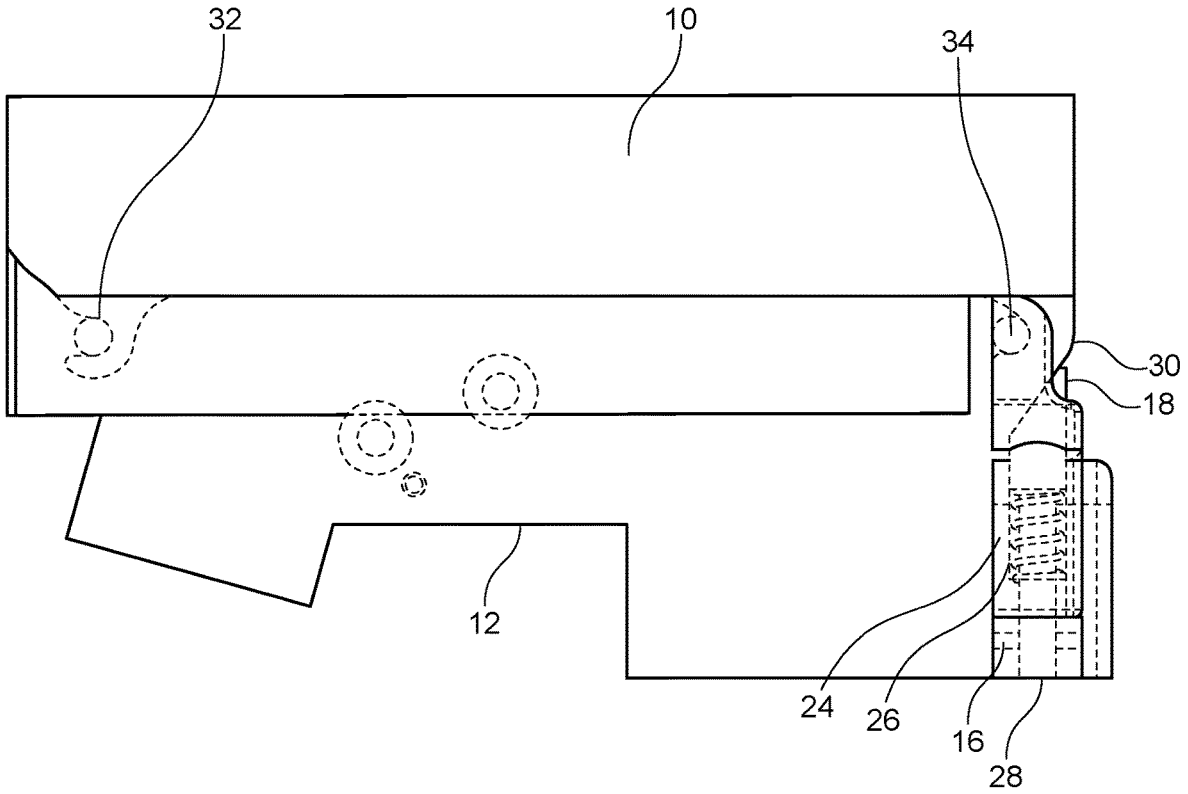
FIG. 3 is a side view of the first example, with the cam arm 14 in the "closed" position, and with the lower assembly 12 shown with invisible walls to reveal certain inner components of the lower assembly 12.
Figure 4:
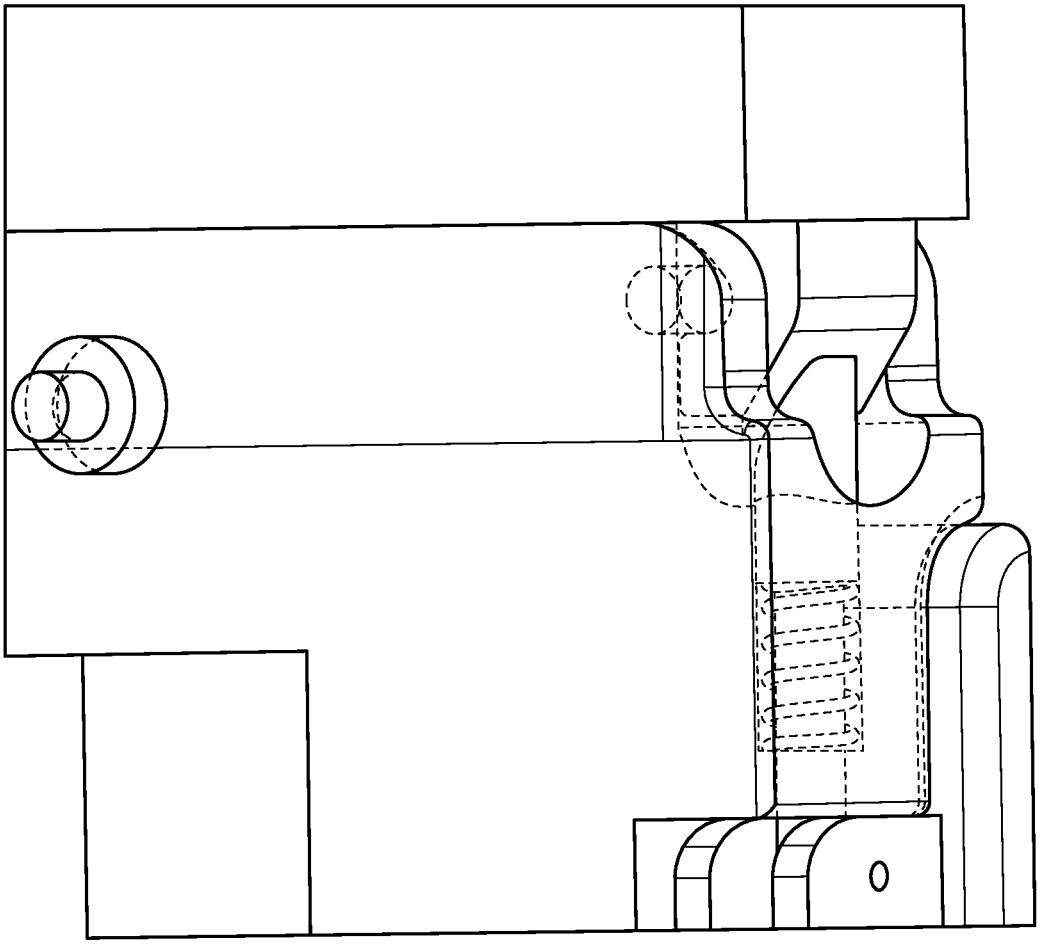
FIG. 4 is an isometric view of the first example, with the cam arm 14 in the "closed" position, and with the lower assembly 12 shown with invisible walls to reveal certain inner components of the lower assembly 12.
Figure 5:
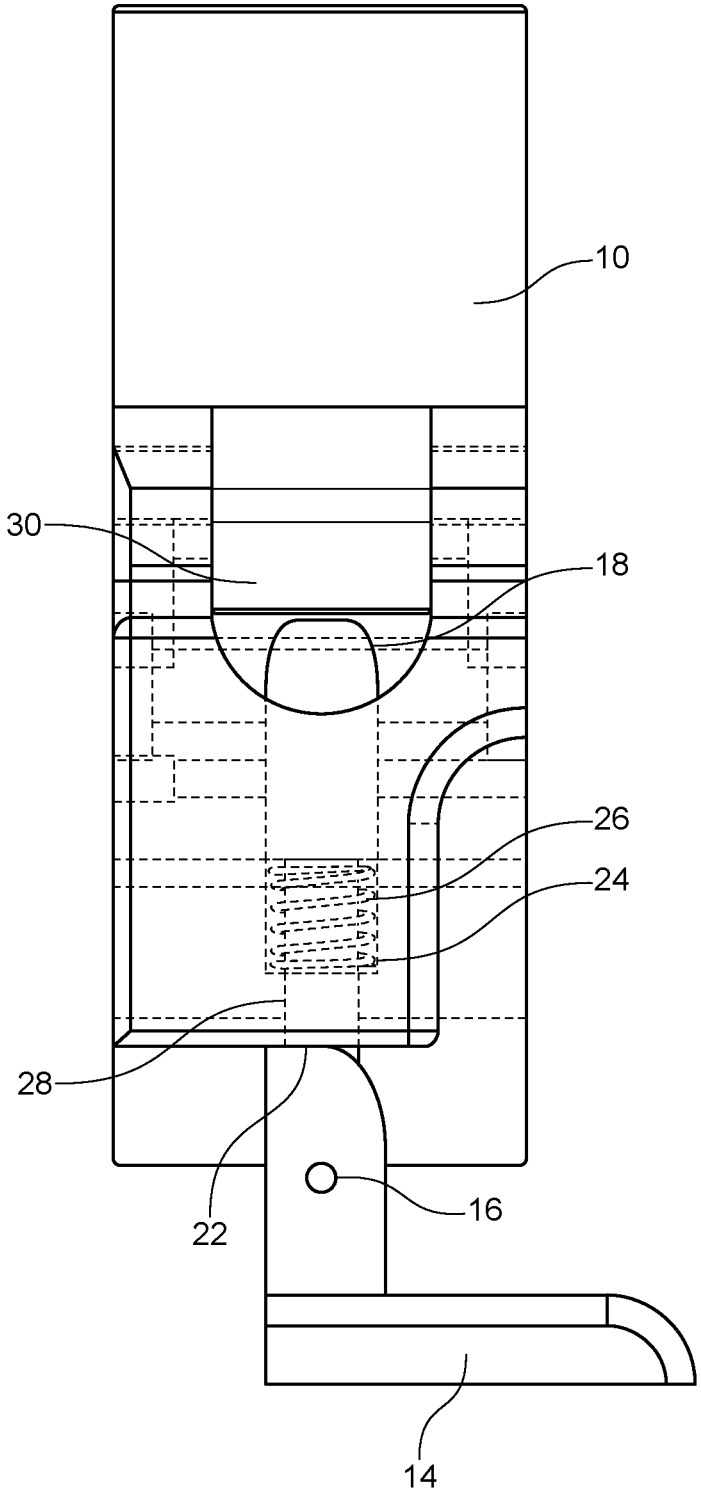
FIG. 5 is a back view of the first example, with the cam arm 14 in the "open" position, and with the lower assembly 12 shown with invisible walls to reveal certain inner components of the lower assembly 12.
Figure 6:
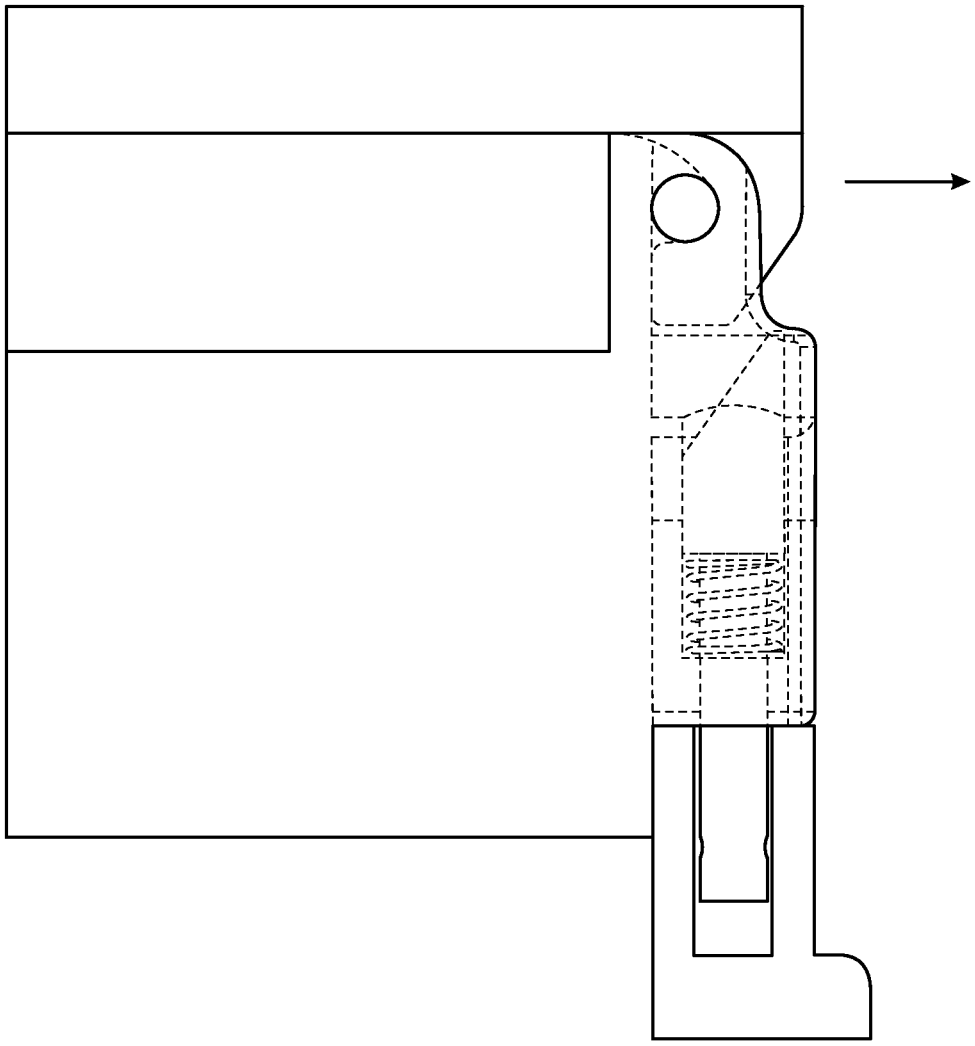
FIG. 6 is a side view of the first example, with the cam arm 14 in the "open" position, and with the lower assembly 12 shown with invisible walls to reveal certain inner components of the lower assembly 12.
Figure 7:
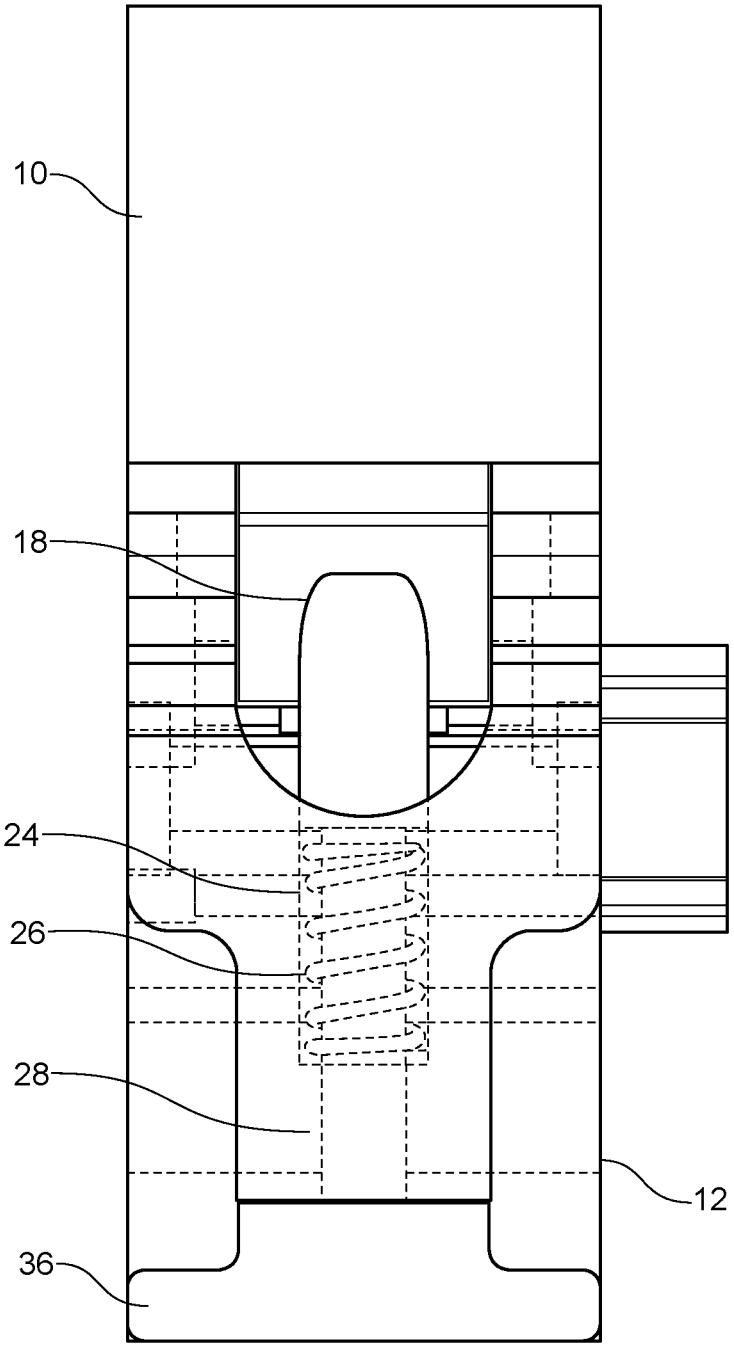
FIG. 7 is a back view of the second example, with the T-handle 36 in the "closed" position, and with the lower assembly 12 shown with invisible walls to reveal certain inner components of the lower assembly 12.
Figure 8:
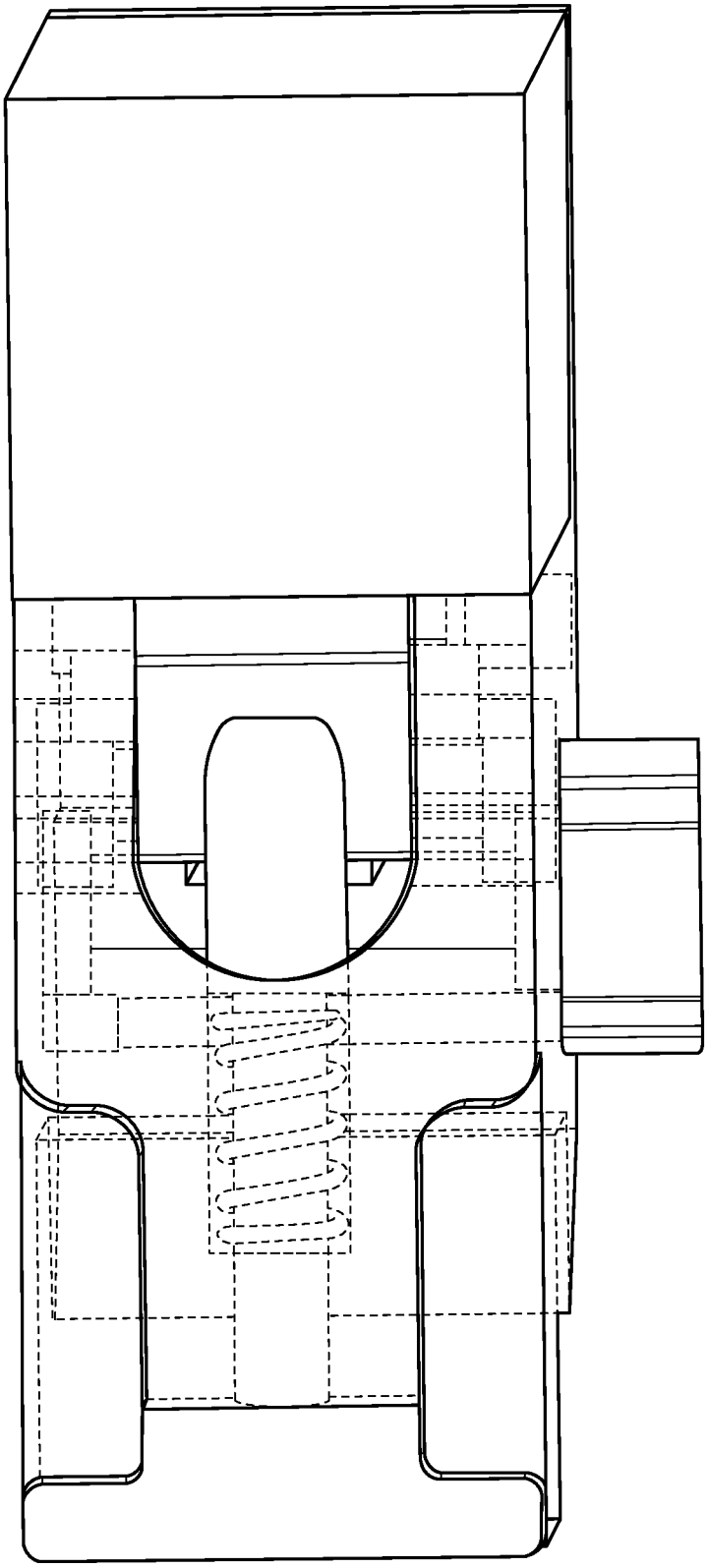
FIG. 8 is a back isometric view of the second example, with the T-handle 36 in the "closed" position, and with the lower assembly 12 shown with invisible walls to reveal certain inner components of the lower assembly 12.
Figure 9:
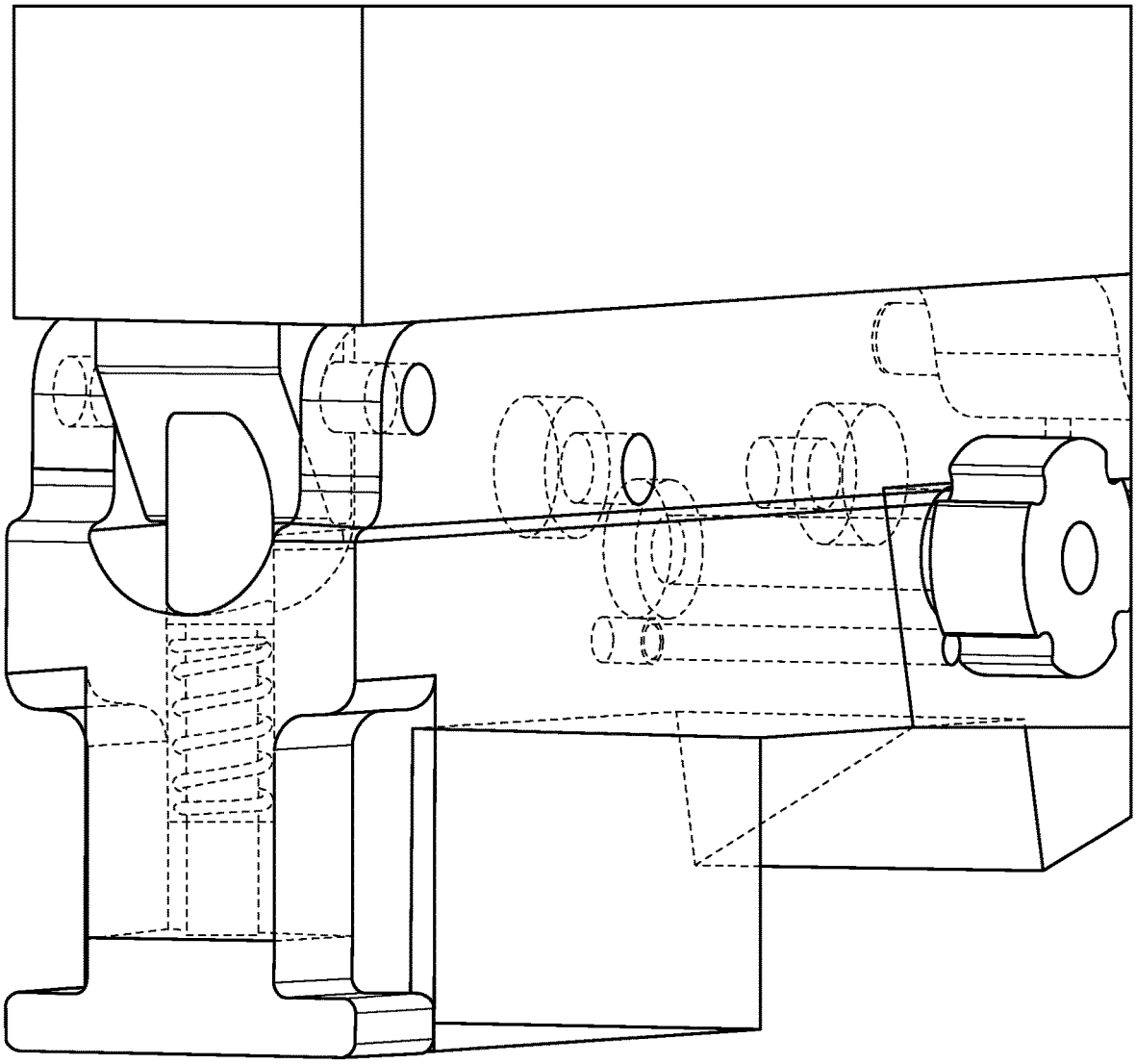
FIG. 9 is an isometric view of the second example, with the T-handle 36 in the "closed" position, and with the lower assembly 12 shown with invisible walls to reveal certain inner components of the lower assembly 12.
Figure 10:
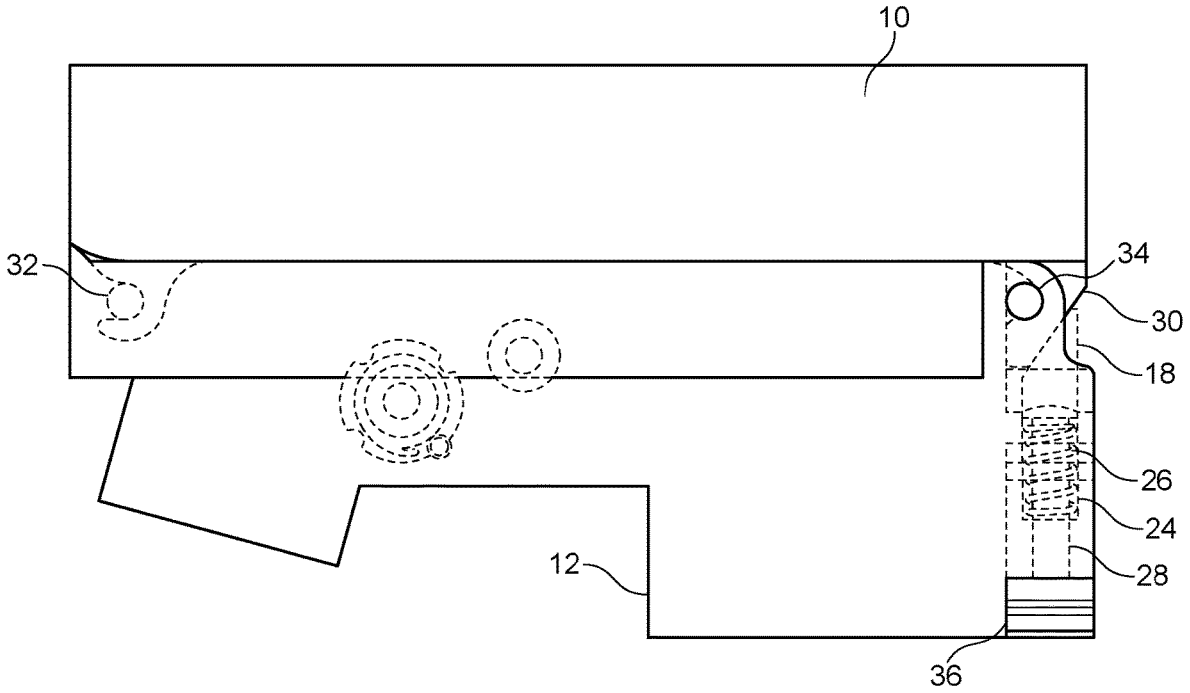
FIG. 10 is a side view of the second example, with the T-handle 36 in the "closed" position, and with the lower assembly 12 shown with invisible walls to reveal certain inner components of the lower assembly 12.
Figure 11:
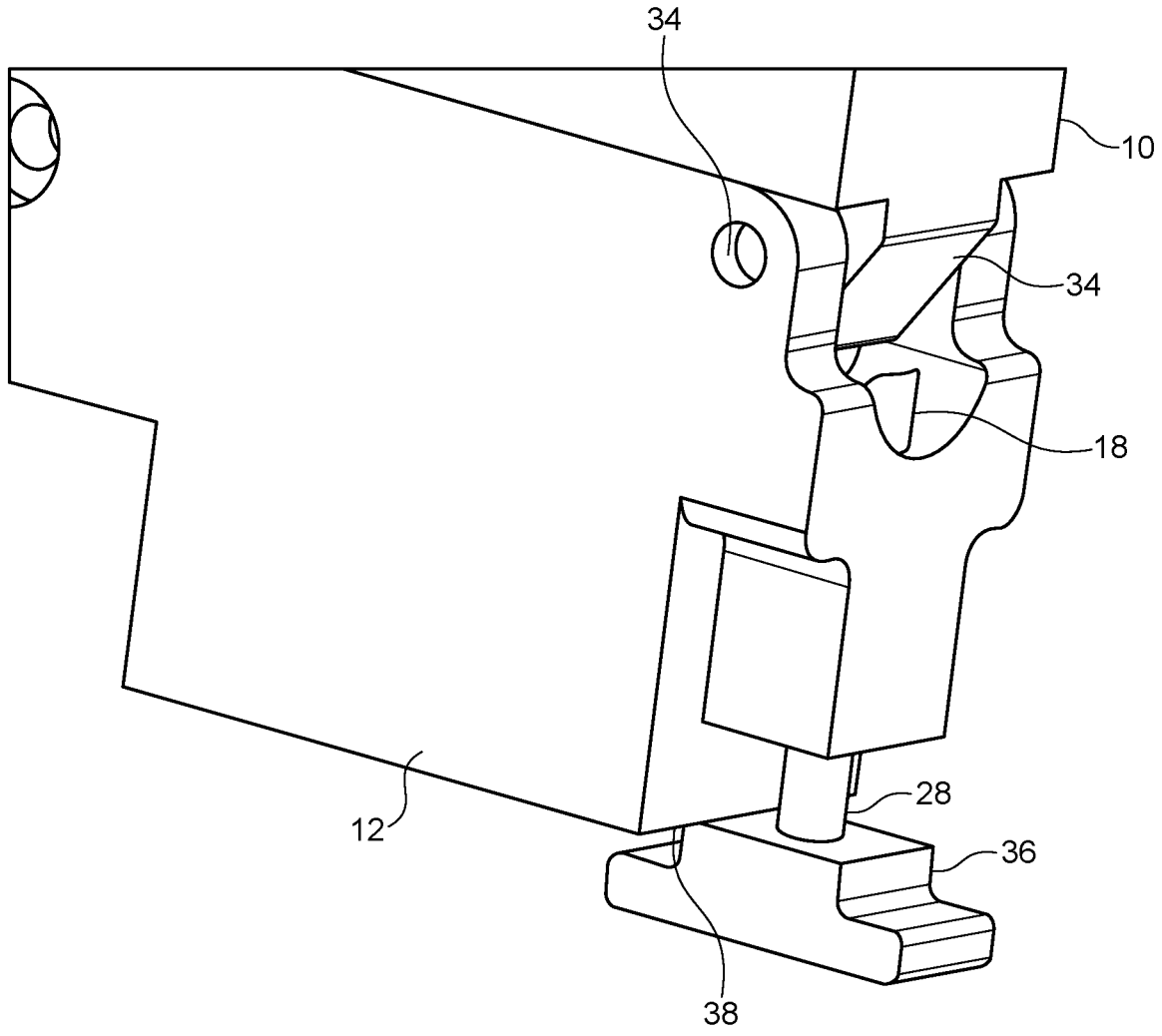
FIG. 11 is an isometric view of the second example, with the T-handle 36 in the "open" position.
Figure 12:
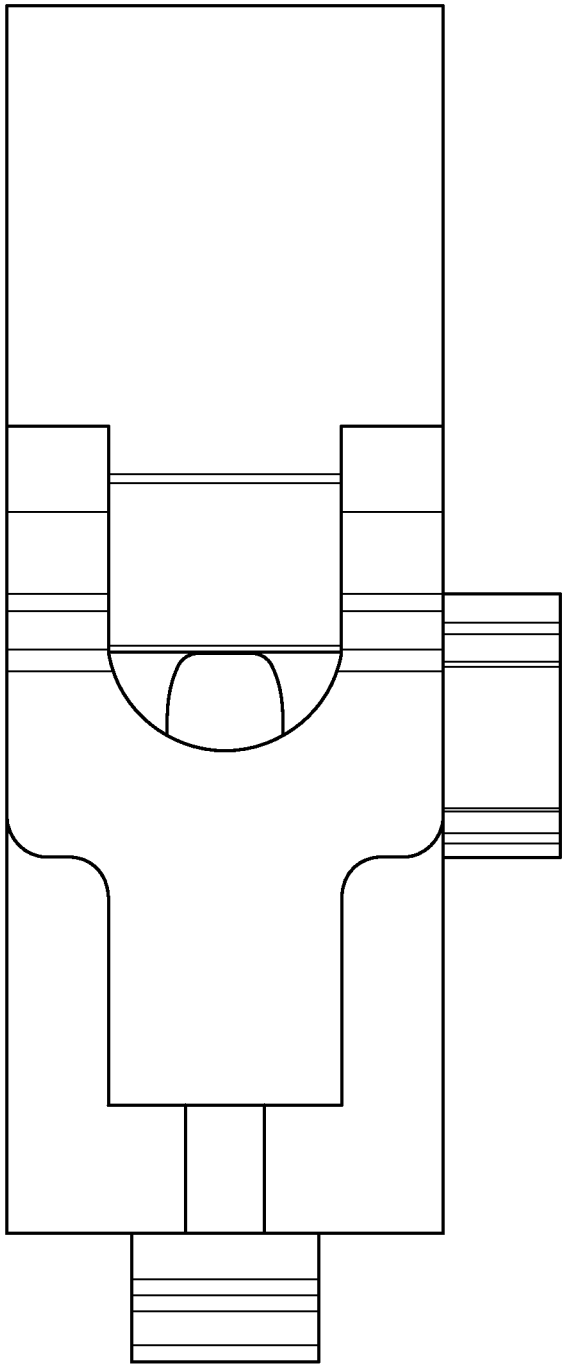
FIG. 12 is a back view of the second example, with the T-handle 36 in the "open" position.
Figure 13:
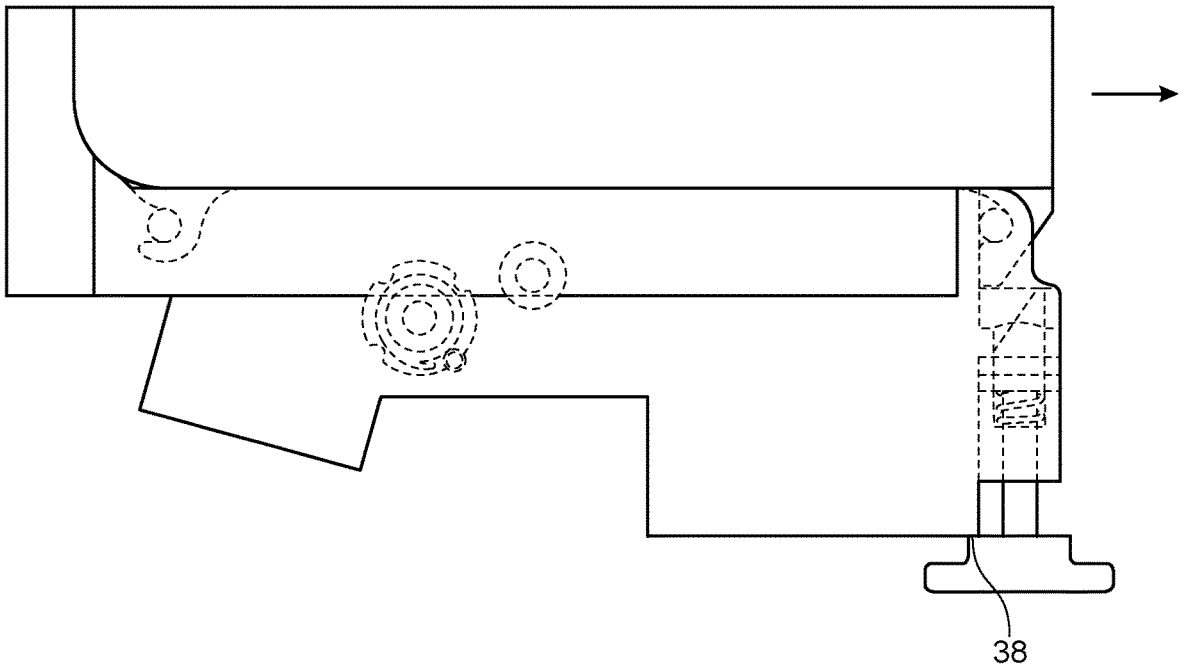
FIG. 13 is a side view of the second example, with the T-handle 36 in the "open" position, and with the lower assembly 12 shown with invisible walls to reveal certain inner components of the lower assembly 12.
Figure 14:
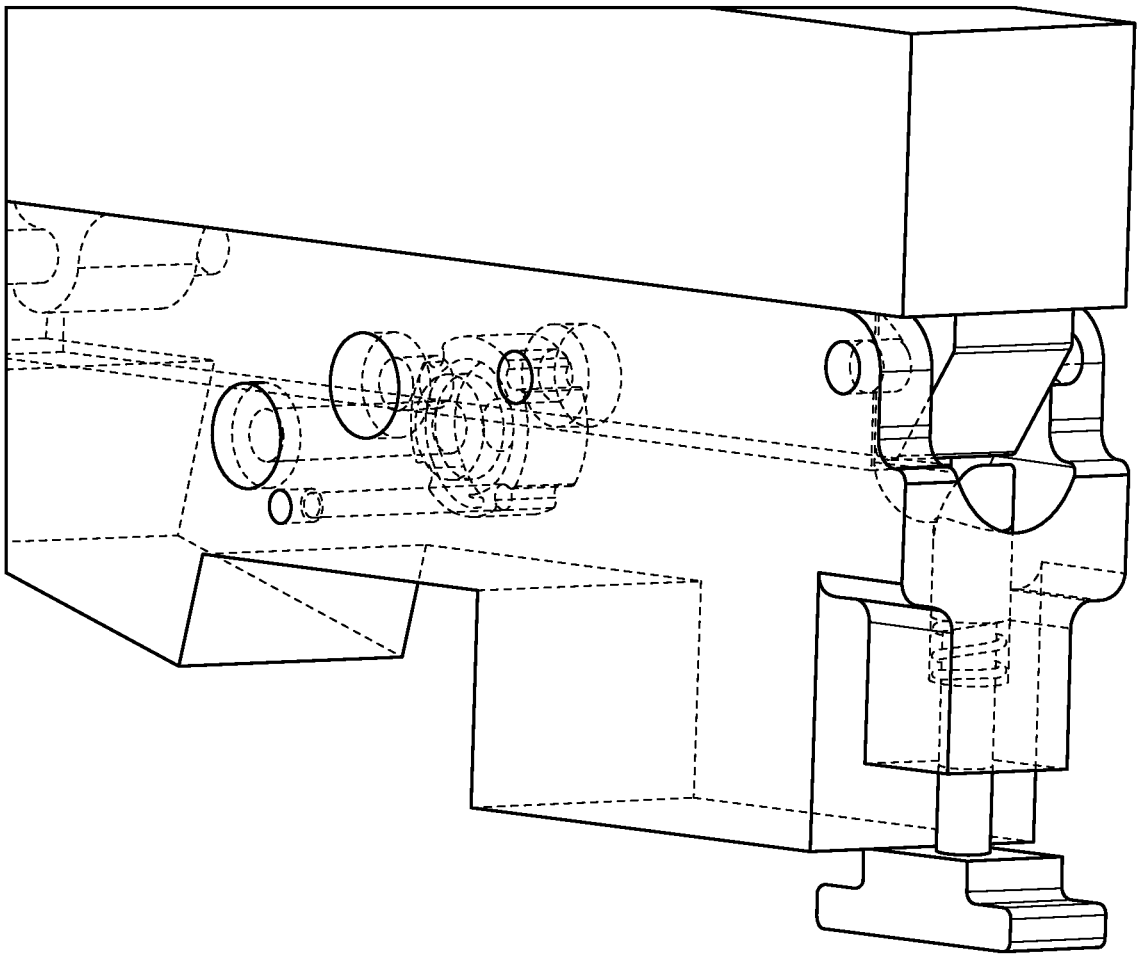
FIG. 14 is an isometric view of the second example, with the T-handle 36 in the "open" position, and with the lower assembly 12 shown with invisible walls to reveal certain inner components of the lower assembly 12.
Figure 15:
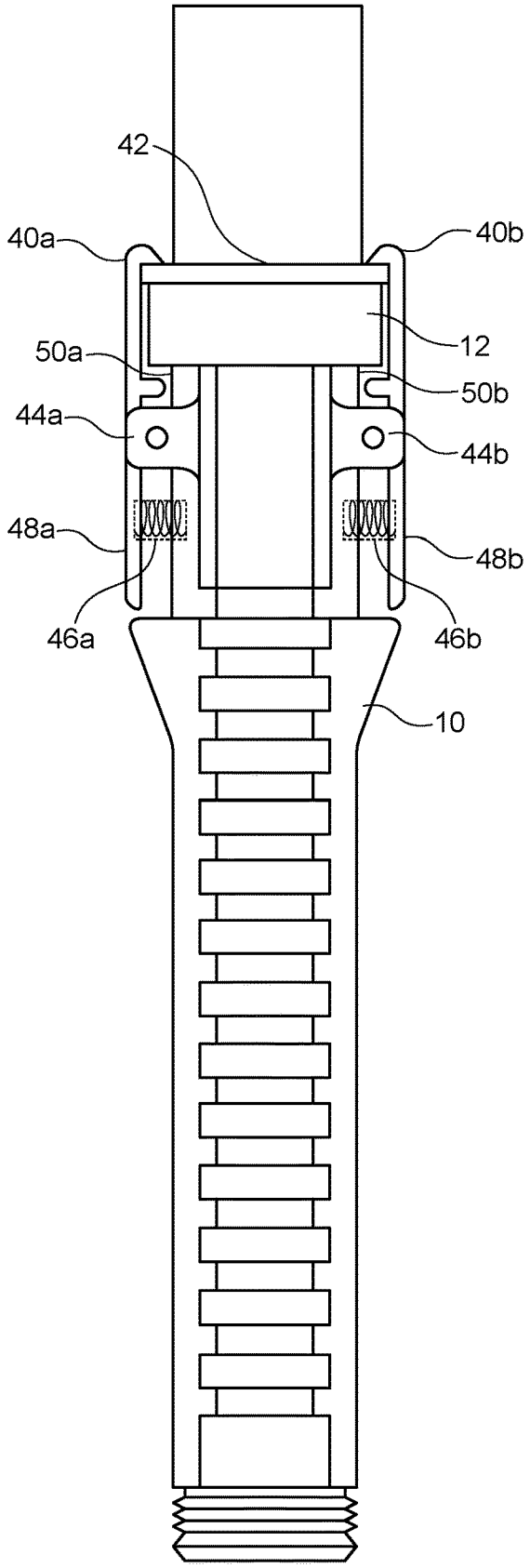
FIG. 15 is a top view of the third example in the "closed" position with the upper assembly 10 attached to the lower assembly 12.
Figure 16:
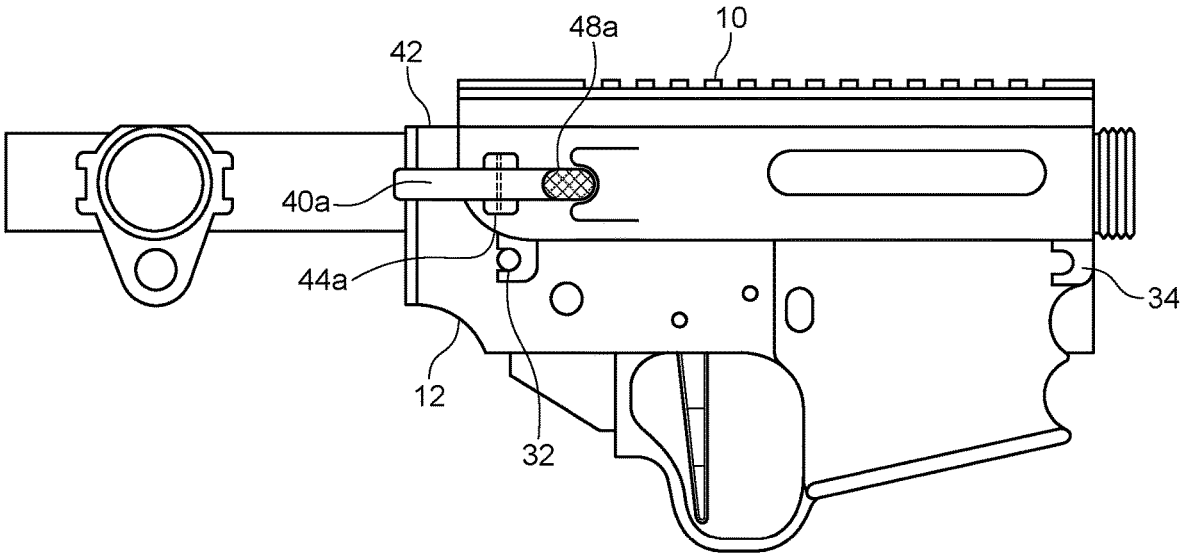
FIG. 16 is a side view of the third example in the "closed" position with the upper assembly 10 attached to the lower assembly 12.
Figure 17:
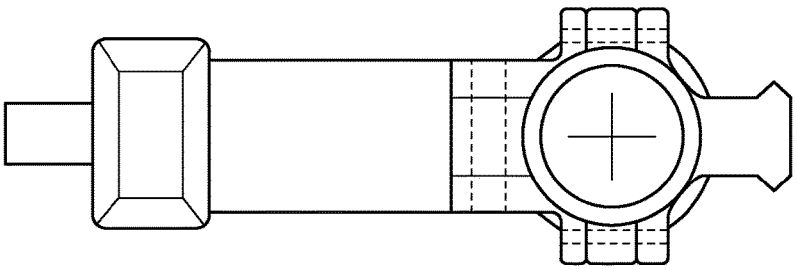
FIG. 17 is a back view of the third example in the "closed" position with the upper assembly 10 attached to the lower assembly 12.

While the invention is described herein in terms of an example and generally associated methods, the inventor contemplates that alterations and permutations of the exemplary embodiments and methods will become apparent to those skilled in the art upon a reading of the specification and a study of the drawings.

Accordingly, the above description of examples is not intended to constrain the invention.

What is claimed is:

1. A take-down assembly for a weapon, comprising:

a. a lower assembly;

b. an upper assembly configured to couple with the lower assembly;

c. a wedge located within the lower assembly and configured to lock the upper assembly coupling to the lower assembly by force of a spring located within a bore of the lower assembly; and d. a handle coupled to the wedge and configured to pull the wedge away from the upper assembly and compress the spring, thereby unlocking the upper assembly coupling to the lower assembly.

2. The take-down assembly of claim 1, wherein the handle is an L-shaped cam arm that rotates on a cam pin and fits into a groove of the lower assembly.

3. The take-down assembly of claim 1, wherein the handle is a T-handle.

4. The take-down assembly of claim 1, wherein the upper assembly is configured to couple with the lower assembly via hooks on the upper assembly that wrap around pins of the lower assembly.

5. The take-down assembly of claim 4, wherein the pins are roll pins that are pressed into the upper assembly.

6. The take-down assembly of claim 4, wherein the pins are welded to the upper assembly.

7. The take-down assembly of claim 1, wherein the wedge is configured to lock the upper assembly coupling to the lower assembly by pressing against an angled portion of the upper assembly.

8. The take-down assembly of claim 1, wherein the weapon is an AR-15.

9. The take-down assembly of claim 1, wherein the handle is further configured to rotate to an unlocked position that prevents the wedge from contacting the upper assembly.

10. A method of disassembling a weapon, comprising:

a. in a lower assembly of the weapon, pulling a handle coupled to a wedge to move the wedge away from an upper assembly and compress a spring;

b. rotating the handle to a position in which a portion of the handle catches on the lower assembly to unlock the upper assembly by preventing the wedge from contacting the upper assembly; and c. removing the upper assembly from the lower assembly.

11. The method of claim 10, further comprising:

d. coupling the upper assembly with the lower assembly;

e. rotating the handle to a second position; and f. releasing the handle to cause the wedge to contact the upper assembly, thereby locking the upper assembly and the lower assembly in a coupled state.

12. The method of claim 10, wherein the handle is an L-shaped cam arm that rotates on a cam pin and fits into a groove of the lower assembly.

13. The method of claim 10, wherein the handle is a T-handle.

14. The method of claim 10, wherein the weapon is an AR-15.

15. The method of claim 11, wherein the upper assembly is coupled with the lower assembly via hooks on the upper assembly that wrap around pins of the lower assembly.

16. The method of claim 11, wherein the wedge locks the upper assembly and the lower assembly in the coupled state by fitting against an angled portion of the upper assembly.

17. A take-down assembly for a weapon, comprising:

a. a lower assembly; and b. an upper assembly configured to couple with the lower assembly via:

(i) a first spring-loaded clip that is configured to latch onto a side of the lower assembly; and (ii) a second spring-loaded clip that is configured to latch onto the side of the lower assembly.

18. The assembly of claim 17, wherein the first spring-loaded clip is configured to rotate on a first pin in response to a user squeezing a side of the first spring-loaded clip against a first spring force, thereby unlatching the first spring-loaded clip from the side of the lower assembly.

19. The assembly of claim 18, wherein the second spring-loaded clip is configured to rotate on a second pin in response to the user squeezing a side of the second spring-loaded clip against a second spring force, thereby unlatching the spring spring-loaded clip from the side of the lower assembly.

20. The assembly of claim 19, wherein the upper assembly is configured to be removed from the lower assembly when the first spring-loaded clip and the second spring-loaded clip are both unlatched from the side of the lower assembly.

* * * * *